US006641374B2

(12) United States Patent
Kim

(10) Patent No.: US 6,641,374 B2
(45) Date of Patent: Nov. 4, 2003

(54) CYLINDER HEAD COVER STRUCTURE OF HERMETIC MOTOR-DRIVING TYPE COMPRESSOR

(75) Inventor: Jong Hyuk Kim, Changwon (KR)

(73) Assignee: LG Electronics INC (KR)

( * ) Notice: Subject to any disclaimer, the term of this patent is extended or adjusted under 35 U.S.C. 154(b) by 0 days.

(21) Appl. No.: 10/005,046

(22) Filed: Dec. 4, 2001

(65) Prior Publication Data

US 2002/0067997 A1 Jun. 6, 2002

(30) Foreign Application Priority Data

Dec. 6, 2000 (KR) ..... 2000-73869

(51) Int. Cl.[7] ..... F04B 39/00

(52) U.S. Cl. ..... 417/312; 417/415; 181/214; 181/403

(58) Field of Search ..... 417/312, 415, 417/560, 571, 902; 181/212, 214, 403

(56) References Cited

U.S. PATENT DOCUMENTS 3,075,686 A * 1/1963 Steinhagen ..... 417/363
4,715,790 A * 12/1987 Iijima et al. ..... 417/269
5,288,212 A * 2/1994 Lee ..... 417/312
5,525,045 A * 6/1996 Jang ..... 417/284
5,804,777 A * 9/1998 Kim et al. ..... 181/229
6,457,947 B1 10/2002 Seipel et al.

FOREIGN PATENT DOCUMENTS

| | | | |
|---|---|---|---|
| CN | 12 58 814 | | 7/2000 |
| JP | 355093979 A | * | 7/1980 |
| JP | 363085272 A | * | 4/1988 |
| WO | WO/9911929 | | 3/1999 |

* cited by examiner

*Primary Examiner*—Charles G. Freay
*Assistant Examiner*—John F. Belena
(74) *Attorney, Agent, or Firm*—Ostrolenk, Faber, Gerb & Soffen, LLP

(57) ABSTRACT

In a head cover structure of a hermetic motor-driving type compressor, by comprising a front head cover having a space divided into a low-pressure side sucking a refrigerant by being installed a suction muffler and a high-pressure side discharging the refrigerant by an enclosure wall and a rear head cover combined to the rear surface of the front head cover and having a space divided into a low-pressure side and a high-pressure side by an enclosure wall, a flatness of the front head cover can be improved, leakage of a refrigerant gas from the high-pressure side can be prevented, and the cost of materials can be reduced by using an inexpensive steel material.

20 Claims, 5 Drawing Sheets

VIEW A-A

VIEW B-B

CYLINDER HEAD COVER STRUCTURE OF HERMETIC MOTOR-DRIVING TYPE COMPRESSOR

BACKGROUND OF THE INVENTION

1. Field of the Invention

The present invention relates to a hermetic motor-driving type compressor, and in particular to a head cover structure of a hermetic motor-driving type compressor which is capable of preventing leakage of a refrigerant gas at a high-pressure side and a low-pressure side and precisely combining a suction muffler to a head cover with reduced production costs.

2. Description of the Prior Art

Generally, a compressor pressurizes a fluid such as air and a refrigerant gas, etc. A compressor includes a driving unit placed inside a closed container and generating a driving force and a compressing unit being transmitted the driving force from the driving unit, sucking and compressing a refrigerant gas. In the compressor, when a driving force is generated in the driving unit by being applied power, the driving force is transmitted to the compressing unit, the compressing unit sucks a gas, compresses and discharges it.

In addition, a head cover structure used for the conventional hermetic motor-driving type compressor is divided into a high-pressure side and a low-pressure side in which a working fluid flows by an enclosure wall, and a suction muffler is installed at the low-pressure side.

As depicted in FIG. 1, a general hermetic motor-driving type compressor includes a closed container 1 formed by combination of an upper container 1*a* and a lower container 1*b,* and a motor driving unit and a compressing unit are formed inside the closed container 1.

The driving unit includes a stator 3, a plurality of springs 2*s* fixedly combined between the stator 3 and the bottom surface of the closed container 1 and elastically supporting the stator 3, and a rotator 4 placed so as to have a certain distance from the stator 3.

In the meantime, the compressing unit includes a hollow crank shaft 5 inserted-combined to the center of the rotator 4, a frame 2 combined between the upper portion of the crank shaft 5 and the upper inner circumference of the rotator 4, a balance weight 5*c* combined to the end of the crank shaft 5, an eccentric pin 5*b* installed at the upper surface of the balance weight $\mathbf{5}^{c}$, a connecting rod 8 combined to a piston 7 slide-inserted into a cylinder 6 formed at the upper surface of the frame 2 and converting a rotation motion of the crank shaft 5 into a linear motion of the piston 7, a valve assembly 9 combined so as to cover a certain surface of the cylinder 6, and a head cover 10 combined to the valve assembly 9.

In the meantime, a piece 5*e* is inserted into the lower portion of the hollow crank shaft 5 in order to suck up oil L from the lower surface of the closed container 1, the sucked oil L is scattered in all internal spaces of the compressor through an oil channel 5*a* connected from the upper portion of the piece 5*e* to the internal space of the eccentric pin 5*b*.

And, the working fluid is supplied to a compressing chamber 6' of the cylinder 6 through a certain side of the head cover 10, a certain side of a suction muffler 11 reducing noise in suction is combined to the head cover 10, and the other side of the suction muffler 11 is connected to a suction pipe 12 suctioning the working fluid and a discharge pipe 23 discharging the compressed working fluid.

Moreover, the suction muffler 11 is made of a plastic material.

Hereinafter, the head cover structure of the conventional hermetic motor-driving type compressor will be described with reference to accompanying FIG. 2.

As depicted in FIG. 2, by an enclosure wall 10*p,* the internal space of the head cover 10 is divided into a lower pressure part 10*b* sucking a low-pressure working fluid by being mounted the suction muffler 11 and a high-pressure part 10*t* discharging the working fluid compressed in the compressing chamber 6'.

And, a gasket 13 and a valve plate 14 of the valve assembly 9 are orderly combined between the head cover 10 and the cylinder 6. In addition, the gasket 13 prevents leakage of the working fluid between the head cover 10 and the valve plate 14, particularly it prevents the leakage of the working fluid between portions corresponded to the upper surface 10*g* of the enclosure wall lop and the valve plate 14.

Hereinafter, the operations of the conventional hermetic motor-driving type compressor and the head cover will be described.

In the conventional hermetic motor-driving type compressor, when power is applied, the rotator 4 rotates by the electromagnetic interaction between the rotator 4 and the stator 3, and the crank shaft 5 constructed so as to be one-bodied with the rotator 4 also rotates.

By the operation, the eccentric pin 5*b* formed to be offset from a center of rotation of the crank shaft 5 performs the rotation circle motion, the connecting rod 8 connected to the eccentric pin 5*b* works together, and the piston 7 performs a linear reciprocating motion.

By the linear reciprocating motion of the piston 7, the working fluid is compressed in the compressing chamber 6' of the cylinder 6, the compressed working fluid is discharged from the compressing chamber 6', passes the valve plate 14 and reaches the high pressure side 10*t* of the head cover 10. And, the working fluid that reached the high-pressure side passes an additional discharge path (not shown) and a discharge noise reducing structure (not shown) and is discharged outside through the discharge pipe 23.

In the meantime, a low-pressure working fluid passes the suction muffler 11 through the suction pipe 12, reaches the valve plate 14 and flow into the compressing chamber 6' by the control of the valve plate 14.

However, the head cover structure of the hermetic motor-driving type compressor in accordance with the prior art has problems as follows.

The head cover 10 is injection-molded out of aluminum or is cast, when the head cover 10 is molded out of aluminum, production costs may be increased due to the cost of materials. When the head cover 10 is cast, because a precise additional process for creating a flat surface 10*a* of the head cover 10 is required, production costs may be increased.

In addition, in the injection molding of the head cover 10, a bend is generated at the flat surface 10*a* due to heat distortion caused by a non-uniform cooling. Accordingly, there is a gap between the head cover 10 and the valve plate 14, a leakage of the working fluid occurs by the pressure difference between the high-pressure side lot and the low-pressure side 10*b* of the head cover 10, causes a pumping efficiency problem and abnormal operation of the compressor.

And, when a leakage of the working fluid occurs at the head cover 10, because the suction muffler 11 made of plastic material melts under the influence of the high temperature-high-pressure working fluid transmitted from the high-pressure side 10*t* or the gasket 13 ruptures, problems could be caused for the compressor.

In the meantime, in the injection-molding or casting of the head cover 10, because a burr occurs at the external boundary surface, an interference occurs in the combination of the suction muffler 11 and the lower pressure side 10*b* of the head cover 10.

And, a height of the head cover 10 is different from a mounting height of the suction muffler 11, when the head cover 10 mounted with the suction muffler 11 is installed to the cylinder 6, a gap occurs between the head cover 10 and the suction muffler 11, accordingly a leakage of the working fluid may occur.

In order to solve the above-mentioned problems, the mold of the head cover has to be modified or has to be made anew, accordingly, an enormous expense loss may occur.

SUMMARY OF THE INVENTION

In order to solve the above-mentioned problems, it is an object of the present invention to provide a head cover structure for a hermetic motor-driving type compressor, which is capable of reducing the cost of materials.

It is another object of the present invention to provide a head cover structure of a hermetic motor-driving type compressor, which is capable of preventing leakage of a working fluid at a head cover.

It is still another object of the present invention to provide a head cover structure of a hermetic motor-driving type compressor which is capable of preventing interference due to a burr in installation of a suction muffler to a head cover and modifying easily a mounting height in installation of the head cover to a cylinder.

In order to achieve the above-mentioned objects, a head cover structure of a hermetic motor-driving type compressor in accordance with the present invention includes a front head cover 30 having a space divided into a low-pressure side 30*b* sucking a refrigerant by having installed a suction muffler 21 and a high-pressure side 30*t* discharging the refrigerant b) an enclosure wall 30*p*, and a rear head cover 40 combined to the rear surface of the front head cover 30 and having a space divided into a low-pressure side 40*b* and a high-pressure side 40*t* by an enclosure wall 40*p*.

DETAILED DESCRIPTION OF THE PREFERRED EMBODIMENT

Figure 1:
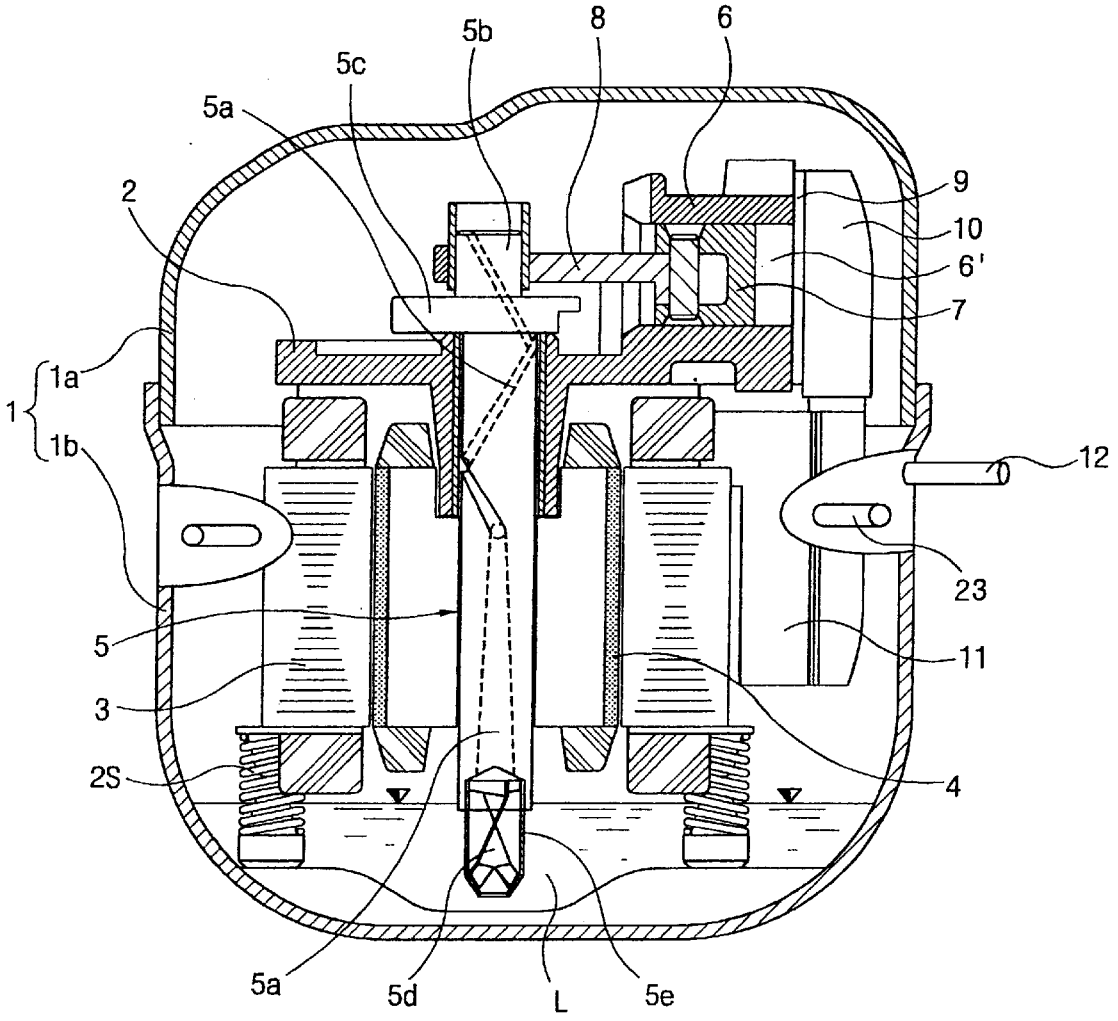
FIG.1 CONVENTIONAL ART
FIG. 1 is a sectional view illustrating an internal structure of a general hermetic motor-driving type compressor.
Figure 2:
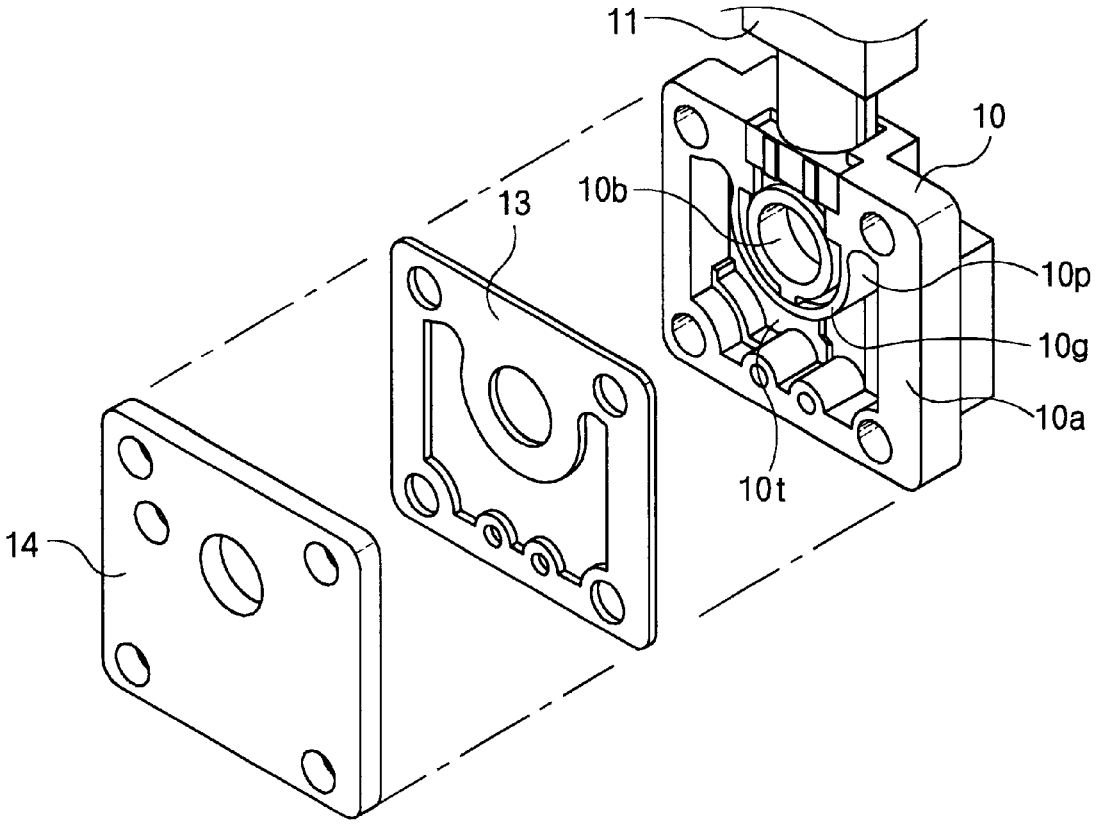
FIG.2 CONVENTIONAL ART
FIG. 2 is a disassembled perspective view illustrating the conventional hermetic motor-driving type compressor.

Hereinafter, the preferred embodiments of a head cover structure of a hermetic motor-driving compressor in accordance with the present invention will be described with reference to accompanying drawings. Herein, construction parts same with the conventional art will be given the same reference numerals, and explanation of those parts will be abridged.

Figure 3:
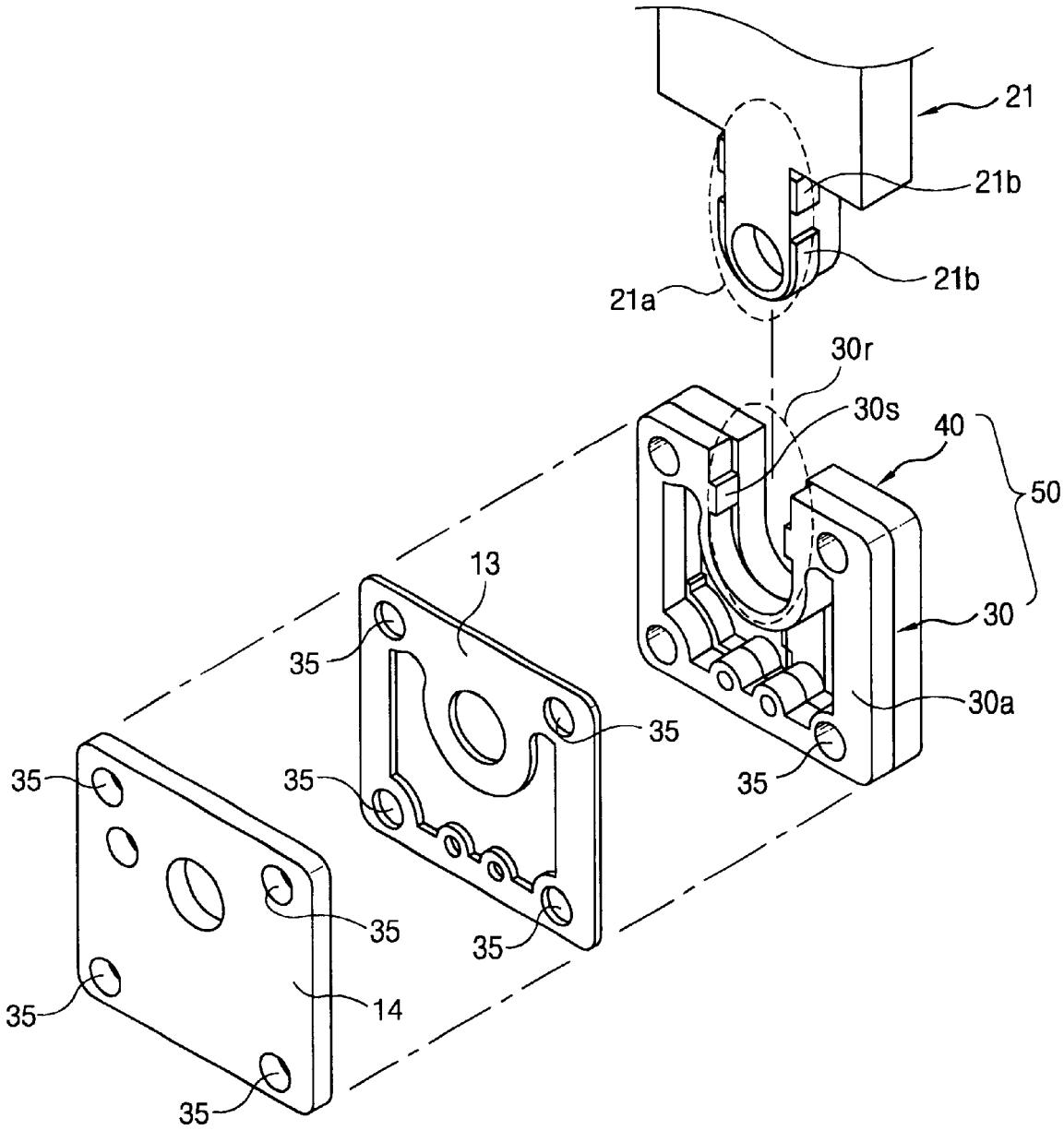
FIG. 3 is a disassembled perspective view illustrating a head cover in accordance with the present invention.

As depicted in FIG. 3, in a head cover structure of a hermetic motor-driving type compressor in accordance with the present invention, in order to form a head cover 50, a front head cover 30 is combined to a rear head cover 40 by brazing welding.

And, in the head cover 50, a through hole 35 for bolt insertion is respectively formed at the front head cover 30 and the rear head cover 40 in order for fastening to a cylinder 6.

In addition, an engaging part 21*a* is formed at the front end of a suction muffler 21 inserted into an engaging groove 30*r* of the head cover 50, and a protrusion portion 21*b* for insertion installation is formed at both sides of the engaging part 21*a*.

Hereinafter, the structure of the front head cover 30 and the rear head cover 40 will be described in detail.

Figure 4A:
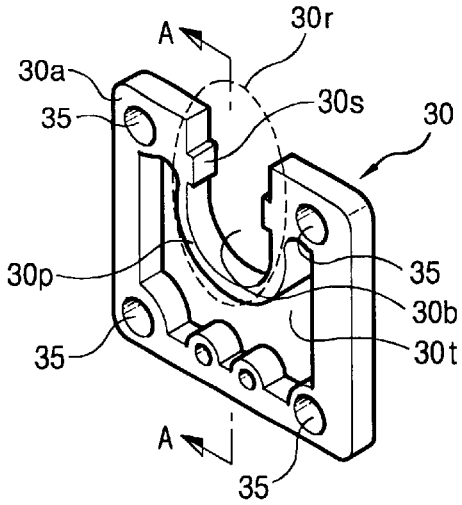
FIG. 4A is a perspective view illustrating a front head cover in accordance with the present invention.

As depicted in FIG. 4A, the front head cover 30 includes a high-pressure side 30*t* in V which the compressed refrigerant flows, a low-pressure side 30*b* in which the engaging part 21*a* of the suction muffler 21 is placed, and an enclosure wall 30*p* is dividing them.

Figure 4B:
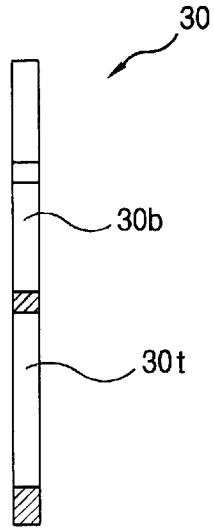
FIG. 4B is a sectional view taken along the line A—A of the front head cover of FIG. 4A.

As depicted in FIG. 4B, the high-pressure side 30*t* and the low-pressure side 30*b* are punched, and the engaging groove 30*r* is formed at the low-pressure side 30*b* in order to be inserted by the protrusion portion 21*b* formed at the engaging part 21*a* of the suction muffler 21. And, an engaging groove protrusion portion 30*s* is formed at the inner circumference of the engaging groove 30*r* to be corresponded to the shape of the protrusion portion 21*b* formed at the suction muffler 21.

And, the front head cover 30 is made of a steel plate by a press process, a flatness of the flat surface 30*a* formed at the front head cover 30 can be improved in comparison with the conventional art, and the cost of materials can be reduced by using a steel material cheaper than aluminum.

Figure 5A:
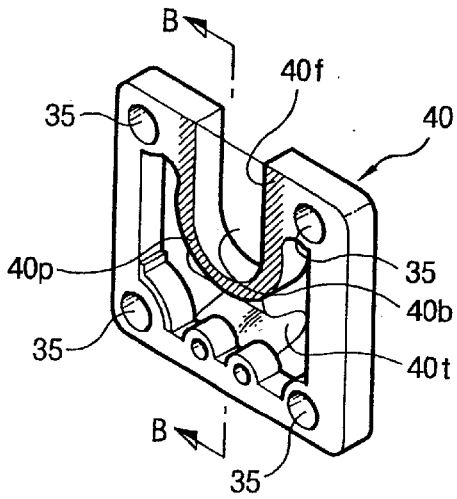
FIG. 5A is a perspective view illustrating a rear head cover in accordance with the present invention.

In the meantime, as depicted in FIG. 5A, the rear head cover 40 combined to the front head cover 30 by a brazing welding is made of a steel plate by a press process, and includes a low-pressure side 40*b* in which the suction muffler 21 is installed and the high-pressure side 40*t* in which the compressed working fluid flows.

Figure 5B:
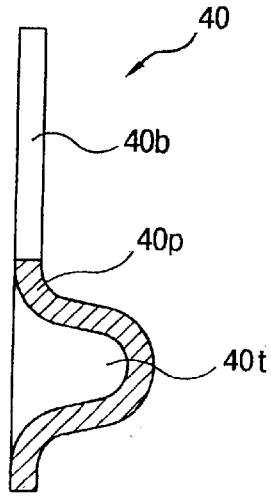
FIG. 5B is a sectional view taken along the line B—B of the rear head cover of FIG. 5A.

In addition, as depicted in FIG. 5B, the rear surface of the high-pressure side 40*t* is convexly formed, and the low-pressure side 40*b* is punched. In the meantime, the enclosure wall 40*p* is formed between the low-pressure side 40*b* and the high-pressure side 40*t* in order to prevent mixing of the working fluid.

In addition, an engaging flat portion 40*f* is formed around the low-pressure side 40*b* in order to fix tightly the front surface of the inserted suction muffler 50 to the cylinder when the suction muffler 21 is installed to the cylinder after being assembled to the head cover 50.

Hereinafter, the assembly of the head cover structure of the hermetic motor-driving type compressor in accordance with the present invention will be described in more detail.

First, as described above, the front head cover 30 is combined to the rear head cover 40 by the brazing welding. After, the suction muffler 21 is inserted into the front head cover 30 from the top to the bottom of the front head cover 30. It is possible to insert the suction muffler 21 by fabricating it with a plastic material.

And, in the insertion, the protrusion portion 21*b* formed at the engaging part 21*a* of the suction muffler 21 is in gear with the protrusion portion 30*s* of the engaging groove 30*r* formed at the front head cover 30, and the rear surface of the suction muffler 21 is contacted to the engaging flat part 40*f* formed at the front surface of the rear head cover 40.

And, the gasket 13 and the valve plate 14 for adjusting flow of the working fluid which are contacted to the flat surface 30*a*, are placed between the head cover 50 and the cylinder 6.

Next, a fastening means such as a bolt, etc. penetrates the through hole 35 formed at the head cover 50, the gasket 13 and the valve plate 14 and is combined to a corresponded engaging hole (not shown) of the cylinder 6.

Hereinafter, the operation and effect of the head cover structure of the hermetic motor-driving type compressor in accordance with the present invention will be described.

First, when the compressor operates, the rotation motion of the crankshaft 5 is converted into the linearly reciprocating motion of the piston 7 by the connecting rod 8.

When the working fluid is compressed by the piston 7, the working fluid is transmitted to the high-pressure side 30*t* of the head cover 50 through a discharge valve (not shown).

After, the working fluid transmitted to the high-pressure side 30*t* of the head cover 50 passes an additional discharge channel (not shown) and a discharge noise reducing structure (not shown) and is discharged outside through the discharge pipe 13.

In the meantime, a low-pressure working fluid passes the suction muffler 11 through the suction pipe 12, reaches the valve plate 14 and flows into the compressing chamber 6' by the control of valve plate 14.

Accordingly, in the head cover structure of the hermetic motor-driving type compressor, the head cover 50 is constructed with two plates, the front head cover 30 and the rear head cover 40 are made of steel plates by the press process, the cost of materials is reduced in the comparison with the conventional aluminum injection-molding process.

And, the flatness of the flat surface 30*a* formed at the front head cover 30 contacting to the gasket 13 is improved, a leakage of the working fluid and the damage of the suction muffler 21 due to the leakage of the working fluid can be prevented.

In addition, because the front head cover 30 is made of the steel plate by the press process, a burr does not form at the exterior of the product, accordingly the assembly of the suction muffler 21 can be performed easily.

And, during installation of the suction muffler 21 to the head cover 50, when there is a difference in height, the head cover 50 has to be modified, herein the installation height can be easily adjusted by changing a thickness of a steel plate for fabricating the front head cover 30 or changing the position of the protrusion portion 30*s* of the engaging groove formed at the front head cover 30.

In addition, by the installation height adjustment structure, during installation of the suction muffler 21 to the cylinder 6, a leakage occurrence of the working fluid can be easily prevented, and the installation of the suction muffler 21 can be easily performed.

Moreover, in comparison with modification or re-manufacture of a mold in the conventional injection-molding, the production cost can be drastically reduced.

As described above, in the head cover structure of the hermetic motor-driving type compressor in accordance with the present invention, the cost of materials can be reduced. In addition, reliability of the product can be improved by preventing leakage of a working fluid at a head cover.

In addition, in the head cover structure of the hermetic motor-driving type compressor in accordance with the present invention, because a suction muffler can be precisely installed to a cylinder, an installation height can be easily modified, accordingly reliability and a productivity of the product can be improved.

What is claimed is:

1. A cylinder head cover structure of a hermetic motor-driving type compressor, comprising:

a front head cover having a low pressure side through which refrigerant is sucked; and a high pressure side through which compressed refrigerant flows, the low pressure side and high pressure side being divided by a first enclosure wall formed therebetween: and a rear head cover joined to a rear surface of the front head cover and having a low-pressure side and a high-pressure side which are divided by a second enclosure wall;

wherein an engaging groove and protrusion are formed on the front head cover so as to mate with a corresponding protrusion and groove portion formed on a suction muffler.

2. The structure of claim 1, wherein the front head cover and the rear head cover are made of steel and manufactured by a press process.

3. The structure of claim 1, wherein a flat surface is formed at one side of the front head cover in order to join closely the one side of the front head cover to a corresponding surface of a gasket in the assembly of a head cover.

4. The structure of claim 3, wherein the flat surface is formed on a steel plate forming the head cover by a press process.

5. The structure of claim 4, wherein the front head cover is assembled to the rear head cover by brazing or welding.

6. The structure of claim 1, wherein a rear surface of the suction muffler is contacted to an engaging flat part formed at a front surface of the rear head cover.

7. The structure of claim 1, wherein the high-pressure side and the low-pressure side of the front head cover are formed by punching.

8. The structure of claim 1, wherein the rear head cover having the high-pressure side is convexly formed, and the low-pressure side is punched.

9. The structure of claim 8, wherein an engaging flat portion for tightly fixing the front surface of the inserted suction muffler to the cylinder is formed around the low-pressure side of the rear head cover.

10. A compressor, comprising:

a front head cover having a low pressure side through which refrigerant is sucked; and a high pressure side through which compressed refrigerant flows, the low pressure side and high pressure side being divided by a first enclosure wall formed therebetween; and a rear head cover joined to a rear surface of the front head cover and having a low-pressure side and a high-pressure side, which low pressure side and high pressure side are divided by a second enclosure wall;

wherein an engaging groove and protrusion are formed on the front head cover so as to mate with corresponding protrusion and groove portions formed on a suction muffler.

11. The compressor of claim 10, wherein the front head cover and the rear head cover are made of steel and manufactured by a press process.

12. The compressor of claim 11, wherein a flat surface is formed at one side of the front head cover in order to assemble closely the one side of the front head cover to a corresponded surface of a gasket in the assembly of the head cover.

13. The compressor of claim 12, wherein the flat surface is formed on a steel plate forming the front head cover by a press process.

14. The compressor of claim 10, wherein the front head cover is assembled to the rear head cover by brazing or welding.

15. The compressor of claim 10, wherein a rear surface of the suction muffler is contacted to an engaging flat part formed at a front surface of the rear head cover.

16. The compressor of claim 10, wherein the high-pressure side and the low-pressure side of the front head cover are formed by punching.

17. The compressor of claim 10, wherein the rear head cover having the high-pressure side is convexly formed, and the low-pressure side is punched.

18. The compressor of claim 17, wherein an engaging flat portion for tightly fixing the front surface of the inserted suction muffler to the cylinder is formed around the low-pressure side of the rear head cover.

19. A cylinder head cover structure of a hermetic motor-driving type compressor, comprising:

a head cover having a low-pressure side through which refrigerant is sucked, and a high pressure side through which compressed refrigerant flows, the low pressure side and the high pressure side being divided by an enclosure wall formed therebetween; and wherein an engaging groove and protrusion are formed on the head cover so as to mate with corresponding protrusion portion and groove portions formed on the suction muffler.

20. The structure of claim 19, wherein the head cover is made of steel and manufactured by a press process.

* * * * *